US006098962A

United States Patent [19]

Henly

[11] Patent Number: 6,098,962

[45] Date of Patent: Aug. 8, 2000

[54] WINCH

[75] Inventor: Nicholas Charles Henly, Petersfield, United Kingdom

[73] Assignee: Lewmar Mrine Limited, Havant, United Kingdom

[21] Appl. No.: 09/021,408

[22] Filed: Feb. 10, 1998

[30] Foreign Application Priority Data

Mar. 4, 1997 [GB] United Kingdom ..... 9704479
Jun. 30, 1997 [GB] United Kingdom ..... 9713854

[51] Int. Cl.[7] ..... B66D 1/00

[52] U.S. Cl. ..... 254/333; 254/383

[58] Field of Search ..... 254/271, 272, 254/333, 371, 372, 383, 269, 274, 277; 226/168, 182, 183

[56] References Cited

U.S. PATENT DOCUMENTS

| | | | |
|---|---|---|---|
| 2,529,084 | 11/1950 | King | 254/383 X |
| 2,625,373 | 1/1953 | Hunt | 254/333 |
| 3,056,586 | 10/1962 | Burrows | 254/271 |
| 3,614,067 | 10/1971 | Vermette | 254/333 X |
| 3,836,123 | 9/1974 | Bausenbach et al. | 254/333 X |
| 3,847,378 | 11/1974 | Roemer et al. . | |
| 4,294,429 | 10/1981 | Desplats | 254/272 |
| 4,706,940 | 11/1987 | Harig | 254/371 X |
| 4,721,285 | 1/1988 | McMichael | 254/333 |
| 5,186,283 | 2/1993 | Salmon | 254/271 X |
| 5,238,227 | 8/1993 | White . | |
| 5,402,985 | 4/1995 | Owens et al. . | |
| 5,669,575 | 9/1997 | Byle | 254/333 X |

FOREIGN PATENT DOCUMENTS

| | | |
|---|---|---|
| 0 677 480 | 10/1995 | European Pat. Off. . |
| 1 282 985 | 7/1972 | United Kingdom . |

*Primary Examiner*—Donald P. Walsh
*Assistant Examiner*—Emmanuel M. Marcelo
*Attorney, Agent, or Firm*—Liniak, Berenato, Longacre & White

[57] ABSTRACT

A gypsy-type winch has a sheave for driving a rope, chain or rope-chain pulling element. The pulling element is urged into contact with the sheave by a spring assembly acting on the element at positions spaced apart from each other and in different sides respectively of a first diameter extending between the inlet and outlet runs of the element, but both on one side of a second diameter perpendicular to the first.

11 Claims, 6 Drawing Sheets

Fig.8.
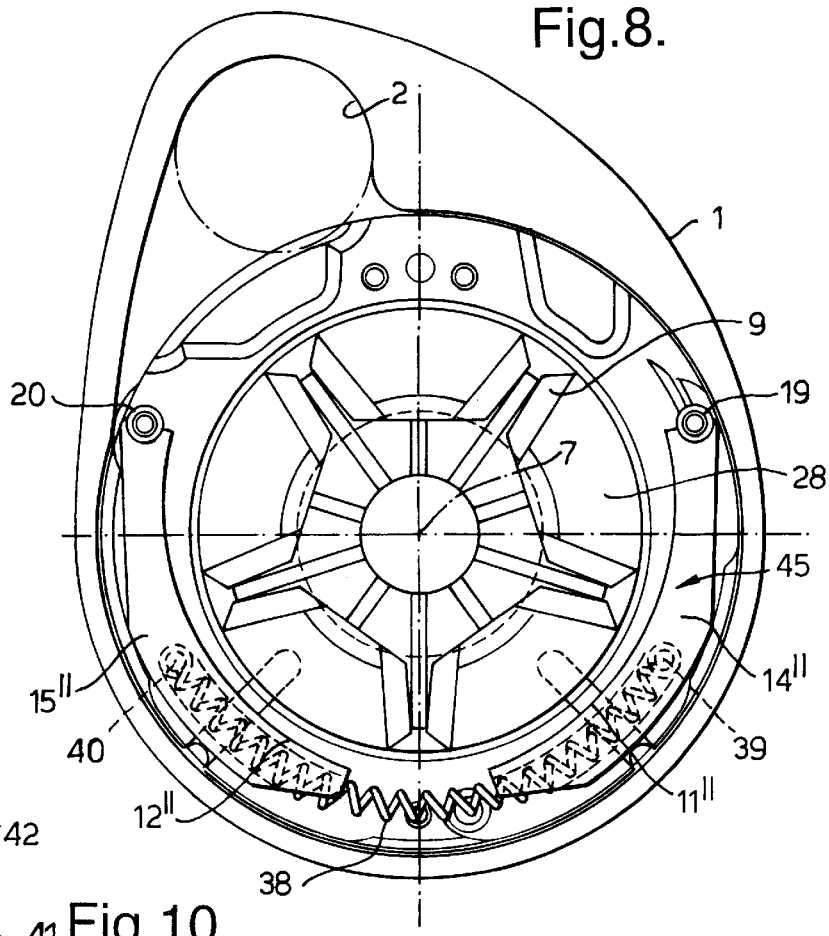
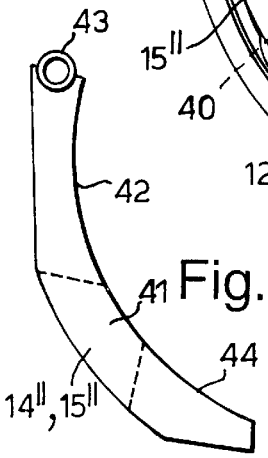
Fig.10.
Fig.9.
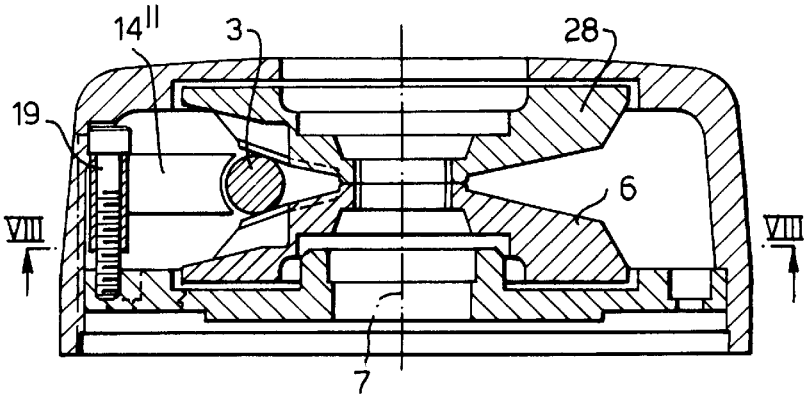

WINCH

BACKGROUND OF THE INVENTION a) Field of the Invention

This invention relates to winches and in particular to a form of winch known as a gypsy, in which a flexible pulling element takes a single turn around a driven rotatable sheave. The flexible pulling element may be a rope, a chain or a combination of these. The latter is most familiar in the marine context where the minor portion of the element closest to an anchor is usually chain but the major portion, that which is closer to the boat, may very well be rope.

b) Description of Related Art

Problems in this type of winch are ensuring as far as possible good grip between the sheave and the flexible element and these problems are particularly acute when the element is a mixed rope and chain and/or when there are irregularities in the flexible element such as twists, knots or thickenings.

It has previously been proposed to provide a pivoting arm or a pivoting spring arm to urge the flexible element into the groove of the sheave. See for example GB-A-2233623, U.S. Pat. No. 5,402,985 (both having pivoted arms) and WO-A-96/09980 where a part described as a guide arm is rigidly attached to a housing at one of its ends.

A guide arm rigidly fixed at one end will if it is entirely rigid jam if there is any thickening in the flexible element passing it or will have to rely on its own inherent resilience to exert an effective force on that element.

A problem with the spring constructions is that they urge the flexible element inwardly only at one radius of the sheave so that, if it is desired to pay out rather than pull in the flexible element, there is no provision for maintaining what is now the incoming side of the element in contact with the sheave and it may escape, come loose, tangle or twist.

SUMMARY OF THE INVENTION

The present invention aims to provide an efficient pressure exerting means for a winch of the gypsy type which at the same time allows for reversibility of the gypsy. The construction also is such that the passage of a thickening in the element at one radius of the winch will not affect deleteriously the operation of the device at other positions.

The invention therefore provides a winch of the gypsy type in which a flexible pulling element is urged into the groove of a rotatable sheave at two spaced apart radii of the sheave by a spring assembly secured at each of its ends to fixed anchorage points, those anchorage points being on one side of a diameter through the axis of rotation of the sheave, the spring extending from one to another via the other side of that diameter of the sheave.

In a preferred embodiment the spring element is a spring strip formed to have two divergent arms and a base, the anchor points being at the ends of the arms remote from the base.

In another preferred embodiment the spring has two rigid arms secured at the anchorage points respectively to pivot about them, and a resilient element drawing together the base ends of the arms remote from the anchorage points. The radii of contact will usually be at the other side of the diameter and contact be made by an intermediate portion of the respective arms, and there being no contact at the base or the base end portions of the arms. The diameter is preferably perpendicular to the runs of the flexible element into and out of the gypsy.

The gypsy may in particular be of the type intended to handle a rope/chain combination, that is one which has jaws adapted to engage both the rope and the links of chain.

The invention also provides a method of improving the paying in and out of line from a gypsy-type winch which consists of applying spring pressure to a flexible pulling element lying in the rotatable sheave of the winch by means of a spring element extending around a major part of the sheave and urging the pulling element inwardly at at least two spaced radii of the sheave.

BRIEF DESCRIPTION OF THE DRAWINGS

A particular embodiment of the invention will be described with reference to the accompanying drawings wherein:

FIG. 8 is a view analogous to FIG. 1 of a second embodiment of the invention;

FIG. 9 is a diametrical sectional view through the second embodiment; and

FIG. 10 is a top view of one of the loading arms.

DETAILED DESCRIPTION OF THE INVENTION

Figure 1:
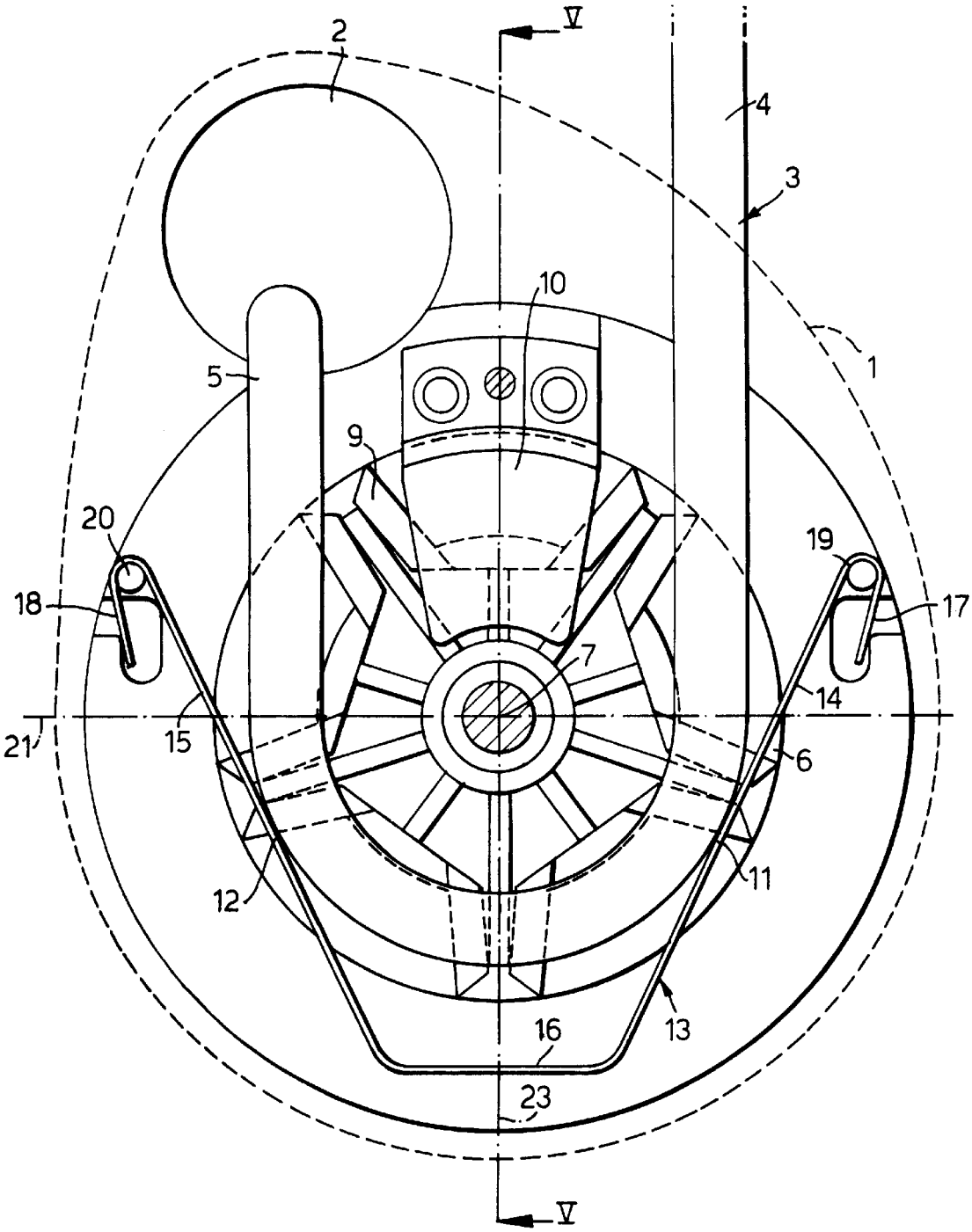
FIG. 1 is a top view of the sheave with an upper jaw of the sheave and an upper cover of a housing removed, to show a rope pulling element passing around the sheave.

In FIG. 1 a housing 1 of a gypsy-type winch is indicated in outline, and an inlet or outlet port 2 for a free end of a pulling element. The flexible pulling element here includes a rope 3 which passes from a tension run 4 to a free run 5. A sheave 6 of which the lower jaw only is shown in FIGS. 1–5 is rotatable about an axis of rotation 7. Together with the top jaw 28 (FIG. 5) it forms a gripping and driving groove 29 for receiving a flexible pulling element such as the rope 3. In a manner known per se the plates are designed to accommodate either a rope such as 3 or a chain 8 (FIGS. 2 and 3), with chain link engaging sprocket teeth 9 arranged at equal pitches around the plates. By virtue of the conicity of the jaws the groove 29 formed between them tapers inwardly and can therefore accommodate, within limits, various dimensions of rope and/or chain.

Between the runs 4 and 5 of the rope a plate 10 projects from a housing of the winch into the groove 29 to prevent rope or chain being carried around the whole of the circumference of the sheave.

For efficient engagement especially of at least the rope portion of the flexible element with the sheave, it is desirable to urge it radially inwardly towards the narrower part of the groove 29.

In the present invention this is achieved at two radii 11 and 12 of the sheave by means of a spring assembly which in this embodiment is a single spring element 13. This spring element has two arms 14 and 15 which diverge from a base 16 and have bent back ends 17 and 18 respectively forming a hairpin. This is looped around respective anchorage points which are posts 19,20 on the housing of the winch. It will be seen that the posts 19,20 are both on one side of a diameter 21 of the sheave through its axis of rotation but that the spring strip 13 extends around the sheave to the other side of that diameter. By virtue of the positioning of the posts 19,20 and the dimension of the base 16, radially inward pressure is exerted on the rope 3 at or about the radial positions 11 and 12.

Figure 2:
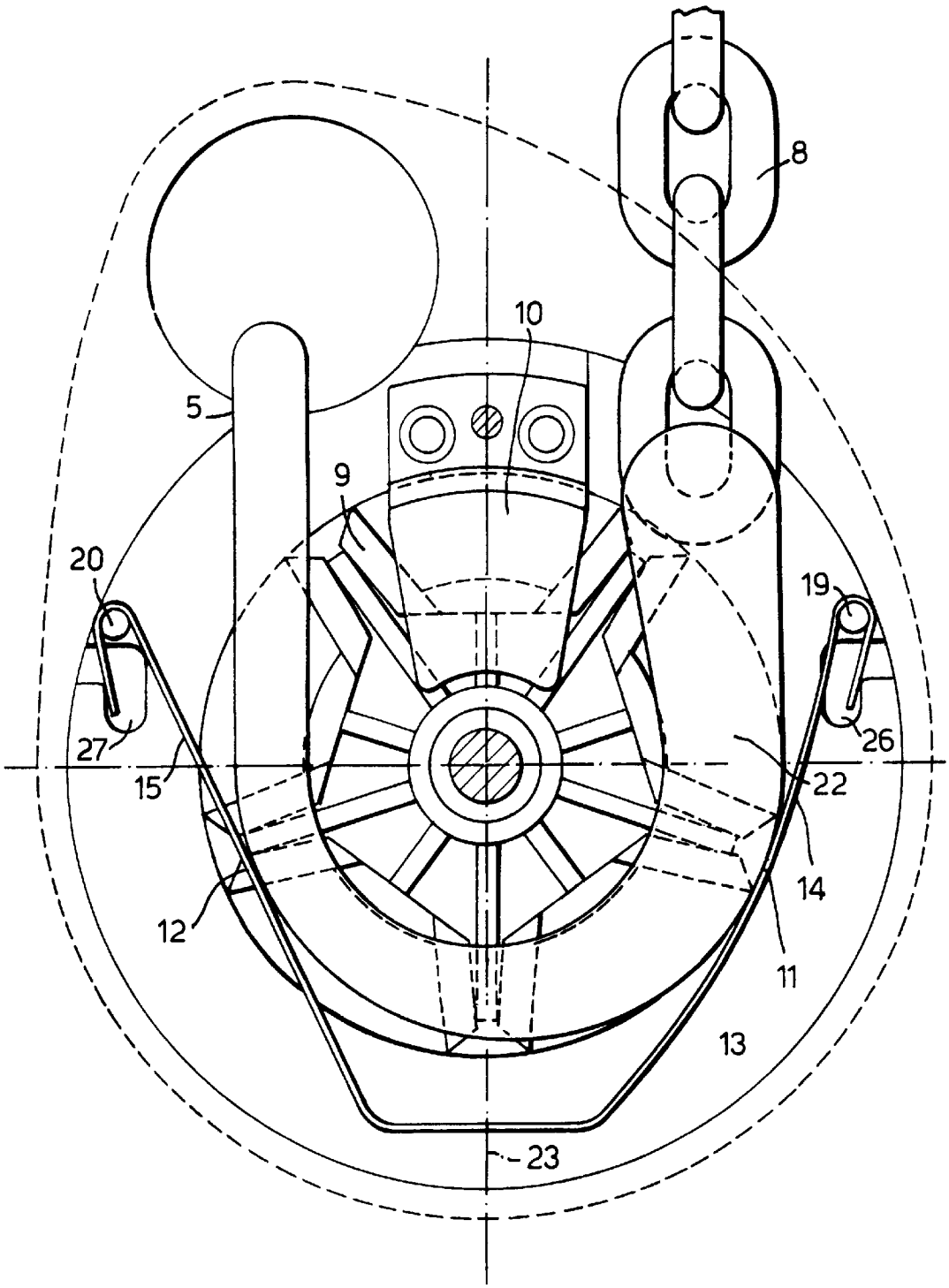
FIG. 2 shows the same but where a join between a rope and chain is approaching the sheave.

The spring strip is yieldable and FIG. 2 shows what happens as the chain 8 approaches when the rope 3 of for example an anchor line has been fully pulled in. The rope 3 is joined to the chain 8 by a splice, knot or binding which has the effect of a considerable thickening in the rope as at 22, FIG. 2.

The figure shows how as this thickening 22 is brought into the groove 29 between the two jaws of the sheave the spring strip 13 can yield so that its arm 14 bulges while maintaining the inward contact at a radial position 11. This bulging of the arm 14 does not however affect the efficiency with which the other arm 15 of the spring strip continues to exert radially inward pressure on the rope 3 at a radial position 12. Indeed, the effect of the distortion of the arm 14 will be if anything to improve the contact between arm 15 and rope 3 at the radius 12.

Figure 3:
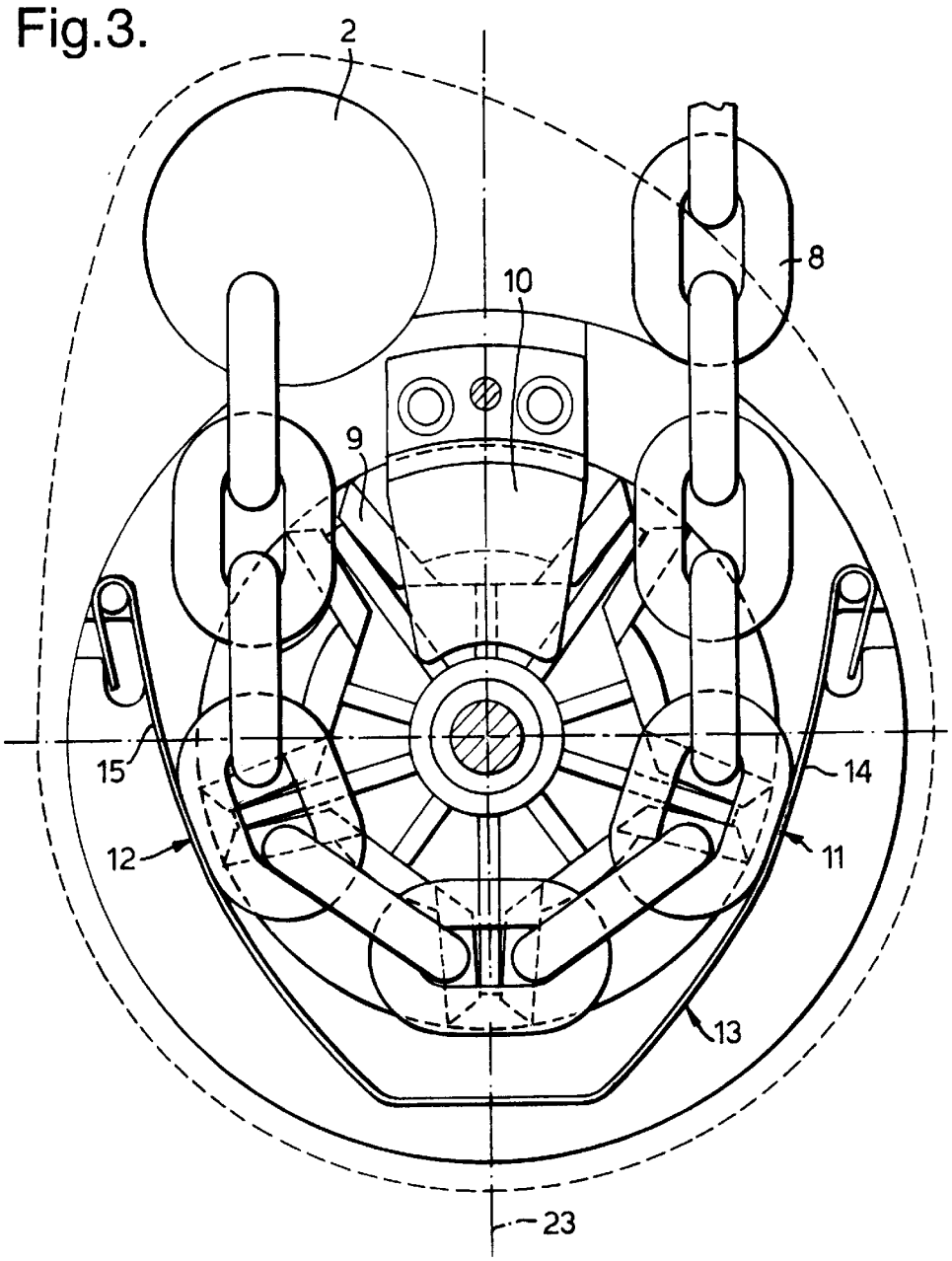
FIG. 3 shows a chain engaged by the same sheave.

FIG. 3 shows the situation when the chain 8 is passing around the sheave and out to the port 2. Now because of the increased effective thickness of the chain both arms 14 and 15 will bulge outwardly but both will maintain the desired radial contact at radii 11 and 12 respectively. Radial positions 11 and 12, respectively, may alter as the thickness of the pulling element, dependent on the shape of the arms and the geometry of the assembly.

The discussion so far has concerned winding in of the line, that is to say with the sheave rotating clockwise as seen in FIGS. 1–4. However, a gypsy will also be used for paying out line, that is with the sheave rotating anti-clockwise as seen in those Figures. If no precautions were taken, the free end of the rope and/or chain could come up into the port 2, now the inlet port, in a tangled or twisted condition and if it entered the groove of the sheave in that state might jam the assembly. It can be seen that the spring being arranged symmetrically in relation to the diameter 23 which is generally parallel to the inlet and outlet runs of the flexible element, the arm 15 of the spring will act to provide efficient engagement of the run which is now the inlet run and will assist in smoothing out tangles or twists which might be in that line, as well as accommodating itself in the manner which has already been described to variations in thickness of that incoming element.

Figure 4:
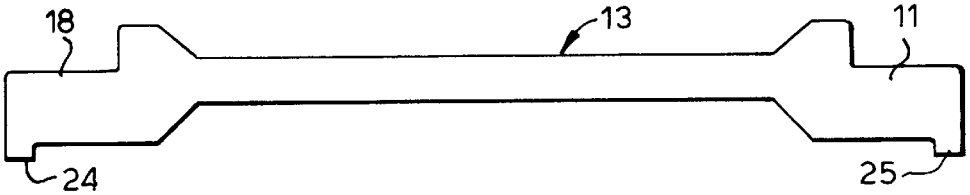
FIG. 4 is a face view of a spring element for the winch.

FIG. 4 shows a blank for forming the strip 13, showing tongues 24,25 which are destined to be on the ends of the turned back hairpin parts 17,18 of the spring and engage in recesses 26,27 in the floor of the housing of the winch adjacent the post 19,20, so as to bias the arms 14,15 inwardly to the desired extent and provide resistance, apart from that provided by the inherent resilience of the spring as against the further anchor post, to the bowing of the arm on the end of which they are to be found.

Figure 5:
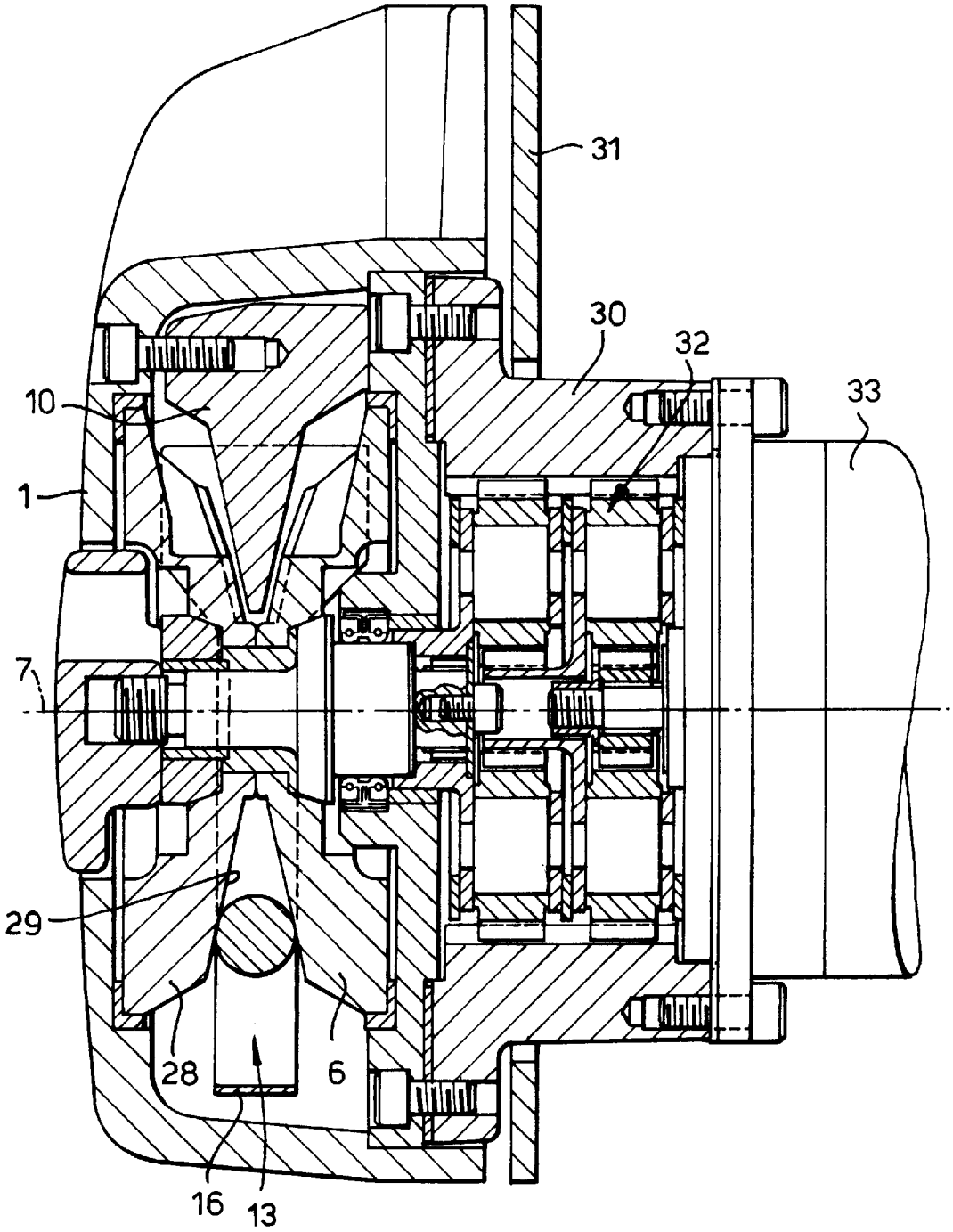
FIG. 5 is a diametrical section on the line V—V, FIG. 1.

FIG. 5 shows how a base 30 of the housing 1 may be positioned on a floor such as a deck 31 of a vessel, and may contain reduction gearing 32 for driving the sheave from a motor 33 mounted below the deck 31.

Figure 6:
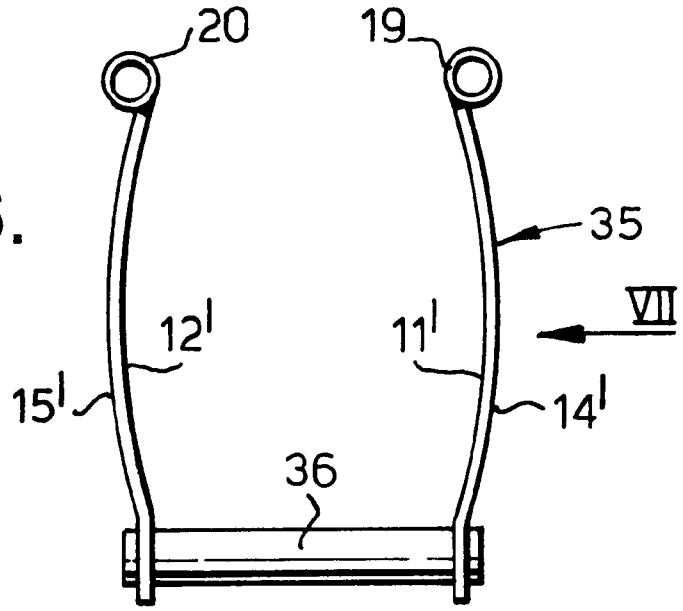
FIG. 6 is a top view of a second embodiment of spring element.
Figure 7:
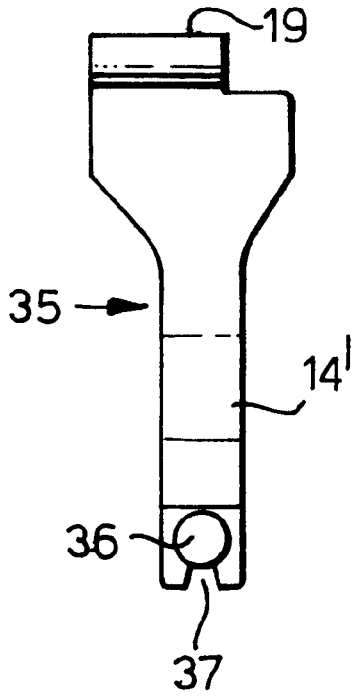
FIG. 7 is a face view of that element on the arrow 7 of FIG. 6.

A modified form of spring assembly is seen at reference 35 in FIGS. 6 and 7. The arms 14',15' are rigid being pivoted on posts 19,20 as before, but at their free ends are united by a rubber cord 36, grooves in which are received in a keyhole slot 37 in the ends of the arms so as to draw the arms 14',15' resiliently together to exert the same actions as described previously on the rope passing round the sheave, in either direction of rotation.

In a second embodiment of gypsy seen in FIGS. 8 to 10, like parts have like numbers as in the first embodiment.

The spring assembly 45 in this embodiment is formed by two rigid arms 14",15" pivoted on posts 19,20 as before and drawn together by a tension spring 38 secured to them at positions 39,40 intermediate their length so as to draw them mutually together and have once more the same action as the spring assemblies of the first embodiment, with contact positions 11",12" respectively which, since the arms are curved, will vary with the thickness of the pulling element.

FIG. 8 shows these arms in their outermost positions, that is with the spring 38 at greatest tension. FIG. 9 shows how the arms (only one being shown) are urged to swing inwardly to press on rope 3.

The arms 14",15" are of part-tubular construction. A central portion 41 (FIG. 10) is tubular but end portion 42 is of channel section until it forms an aperture 43 for anchor post 19,20, and end portion 44 is also of channel section into which the tension spring 38 can enter, helping the spring to be snag-free in its operation as it extends and contracts.

I claim:

1. A winch with a sheave drivingly rotatable about an axis of rotation for engaging a single turn of a flexible pulling element, inlet and outlet runs for conducting said element respectively to and from the single turn, and a spring assembly for contacting said element to urge it resiliently radially towards the sheave between said inlet and outlet runs of said element, at only two circumferentially spaced-apart contact positions around a circumference of the sheave, said contact positions being located symmetrically, one at either side of a first diameter passing through the axis of rotation of the sheave and passing between the inlet and outlet runs.

2. A winch according to claim 1 which is for reception of a said flexible pulling element which has serially a rope and a chain, the sheave having a toothed portion adapted for reception of the chain and the spring assembly being effective to urge at least the rope into contact with the sheave.

3. A winch according to claim 2 wherein the spring assembly comprises rigid arms pivoted at the anchorage points respectively and drawn together by a spring element extending between them.

4. A winch according to claim 1 wherein the spring assembly has anchorage points in the winch at each of its ends, and the spring assembly extends between the anchorage points around the sheave on one side of a second diameter, which is perpendicular to said first diameter, said two contact positions being on said one side of the second diameter.

5. A winch with a sheave drivingly rotatable about an axis of rotation for engaging a single turn of a flexible pulling element, inlet and outlet runs for conducting said element respectively to and from the single turn, and a single spring member having arms for respectively contacting said element to urge it resiliently radially towards the sheave between said inlet and outlet runs of said element, at a plurality of circumferentially spaced-apart contact positions around a circumference of the sheave, said plurality of contact positions including two which are located symmetrically, one at either side of a first diameter passing through the axis of rotation of the sheave and passing between the inlet and outlet runs.

6. A winch according to claim 5 which is for reception of said flexible pulling element which has serially a rope and a chain, the sheave having a toothed portion adapted for reception of the chain and the spring assembly being effective to urge at least the rope into contact with the sheave.

7. A winch according to claim 5 herein the spring assembly has anchorage points in the winch at each of its ends, and the spring assembly extends between the anchorage points around the sheave on one side of a second diameter, which is perpendicular to said first diameter, said two contact positions being on said one side of the second diameter.

8. A winch with a sheave drivingly rotatable about an axis of rotation for engaging a single turn of a flexible pulling element, inlet and outlet runs for conducting said element respectively to and from the single turn, and a spring assembly for contacting said element to urge it resiliently radially towards the sheave between said inlet and outlet runs of said element, said spring assembly comprising rigid arms pivoted at respective anchorage points to effect said contact, and a spring element for drawing said arms pivotally together, said contact being at a plurality of circumferentially spaced-apart contact positions around a circumference of the sheave, said plurality of contact positions including two which are located symmetrically, one at either side of a first diameter passing through the axis of rotation of the sheave and passing between the inlet and outlet runs.

9. A winch according to claim 8 wherein the arms are tubular in section over part of their length and include a channel-section portion, said channel-section portion receiving said spring element.

10. A winch according to claim 8 which is for reception of said flexible pulling element which has serially a rope and a chain, the sheave having a toothed portion adapted for reception of the chain and the spring assembly being effective to urge at least the rope into contact with the sheave.

11. winch according to claim 8 wherein the spring assembly has anchorage points in the winch at each of its ends, and the spring assembly extends between the anchorage points around the sheave on one side of a second diameter, which is perpendicular to said first diameter, said two contact positions being on said one side of the second diameter.

* * * * *